US012285099B2

(12) United States Patent
Rich, Jr.

(10) Patent No.: US 12,285,099 B2
(45) Date of Patent: Apr. 29, 2025

(54) AUTOMATIC HAND SCRUBBING DEVICE

(71) Applicant: John W. Rich, Jr., Gilberton, PA (US)

(72) Inventor: John W. Rich, Jr., Gilberton, PA (US)

( * ) Notice: Subject to any disclaimer, the term of this patent is extended or adjusted under 35 U.S.C. 154(b) by 0 days.

(21) Appl. No.: 18/917,172

(22) Filed: Oct. 16, 2024

(65) Prior Publication Data

US 2025/0031837 A1 Jan. 30, 2025

(51) Int. Cl.

| | |
|---|---|
| ***A46B 13/04*** | (2006.01) |
| ***A46B 5/00*** | (2006.01) |
| ***A46B 11/06*** | (2006.01) |
| ***A46B 13/00*** | (2006.01) |
| ***A47K 7/04*** | (2006.01) |

(52) U.S. Cl.

CPC ..... *A46B 13/04* (2013.01); *A46B 5/0004* (2013.01); *A46B 11/063* (2013.01); *A46B 13/006* (2013.01); *A47K 7/04* (2013.01); *A46B 2200/1013* (2013.01)

(58) Field of Classification Search

CPC ..... A46B 13/02; A46B 13/04; A46B 11/06; A46B 11/063; A46B 11/066; A46B 2200/1006; A46B 2200/306; A46B 2200/3073

USPC ..... 15/34, 36, 88.3

See application file for complete search history.

(56) References Cited

U.S. PATENT DOCUMENTS

| | | | | |
|---|---|---|---|---|
| 2,248,205 | A * | 7/1941 | Henry | A61H 35/00 4/606 |
| 3,081,471 | A * | 3/1963 | Newell | A47K 7/04 4/606 |
| 3,439,370 | A | 4/1969 | McLaughlin | |
| 3,918,117 | A * | 11/1975 | Plante | A47K 7/04 15/88.3 |
| 6,141,811 | A | 11/2000 | Nakamura | |
| 8,146,613 | B2 | 4/2012 | Barnhill et al. | |
| 8,294,585 | B2 | 10/2012 | Barnhill | |
| 2024/0026663 | A1 | 1/2024 | Ackland | |
| 2024/0041267 | A1 | 2/2024 | Kim | |

FOREIGN PATENT DOCUMENTS

JP 4346716 B2 * 10/2009

* cited by examiner

*Primary Examiner* — Eric J Rosen
*Assistant Examiner* — Aaron R McConnell
(74) *Attorney, Agent, or Firm* — McHale & Slavin, P.A.

(57) ABSTRACT

A hand scrubbing device designed for automated and efficient cleaning of hands. The present invention features a housing with a sloped bottom wall for fluid drainage, supporting a chamber that houses three brushes: a lower brush, an upper brush, and a center brush. The lower and upper brushes rotate in opposite directions to scrub the hand, while the center brush focuses on cleaning the fingertips. A motor powers the brushes, and a water source is fluidly connected to a spray nozzle. A micro switch is engaged when a hand is inserted between the upper and lower brushes, activating both the motor and the spray nozzle. The device offers an efficient, accessible solution for thorough hand cleaning and can be adapted for use in various industries where improved hygiene is essential.

6 Claims, 9 Drawing Sheets

AUTOMATIC HAND SCRUBBING DEVICE

FIELD OF THE INVENTION

This invention is related to the field of personal hygiene and, in particular, to an automatic hand scrubbing device.

BACKGROUND OF THE INVENTION

Clean hands are important for hygiene, health, and safety. It is well known that hands are a common pathway for transmitting germs and viruses. Proper handwashing reduces the risk of spreading pathogens. Clean hands are crucial when handling food to avoid contamination. Clean hands reduce the risk of introducing harmful bacteria into cuts or other vulnerable areas on the body which could otherwise lead to infections. In many instances the need to clean the hands is so great that even the attempt to turn on a water faucet can compound the transmission of germs and viruses.

For example, coal miners typically have their hands dirty due to the basic nature of their work. Coal mining involves working with machinery, and dealing with dust and dirt in a limited ventilation areas wherein a significant amount of grime and soot can coat the hands. Even with gloves installed, miners often still come into contact with dirt and coal residue that must be removed from skin for the health and safety of the coal miner. Leaving coal residual on the skin can lead to skin irritation, skin infections, and coal dust includes polycyclic aromatic hydrocarbons which are considered carcinogenic.

Another example is meat packers wherein meat is highly susceptible to bacterial contamination, including harmful pathogens like *E. coli, Salmonella*, and *Listeria*. For this reason, the food industry is heavily regulated with strict hygiene protocols in place. The mere touching of meat with unclean hands could cause foodborne illnesses which necessitates the cleanliness of meat packers handling the meat.

Other industries that would benefit from initial hand cleaning includes healthcare workers; childcare workers, laboratory technicians, mechanics, restaurants, construction workers, animal handlers, pharmaceutical workers, agricultural workers, beauticians, teachers to name a few.

U.S. Pat. No. 3,081,471 discloses a hand washing machine with opposing brushes. The disclosure fails to address the use of a fingertip brush, adjustable brushes, and automatic operation upon insertion of an individual's hands.

What is lacking in the industry is an automated hand scrubbing device that cleans hands and fingertips upon insertion into the device.

SUMMARY OF THE INVENTION

The hand scrubbing device is designed to automate and improve the efficiency of hand cleaning. The present invention features a housing structure with a bottom wall that slopes toward a drainage port, ensuring proper fluid disposal. The housing also supports a rear wall, left and right side walls, and a top panel, which ultimately forms a chamber for the scrubbing components. A water source connects to a spray nozzle within the chamber to disperse fluid during use, ensuring that the hand is adequately rinsed throughout the scrubbing process.

The device is equipped with three brushes: a lower brush, an upper brush, and a center brush. The lower brush rotates in one direction on a horizontal shaft, while the upper brush, mounted above the lower one, rotates in the opposite direction on a separate horizontal shaft that is slidably secured to the side walls via slots. The center brush is mounted vertically, with its shaft extending between the top panel and the bottom wall. This brush arrangement allows for comprehensive cleaning, with the lower and upper brushes cleaning the hand and the center brush specifically targeting the fingertips.

A motor powers the brushes, and the device operates automatically when a hand is inserted between the upper and lower brushes. The act of inserting the hand lifts the upper brush along its slots, activating a micro switch that engages both the motor and the spray nozzle. This triggers the rotation of the brushes and disperses water from the spray nozzle, allowing for efficient, hands-free scrubbing.

An objective of the invention is to provide efficient and automated hand cleaning. The device is designed to thoroughly scrub an individual's hands using rotating brushes, minimizing the effort required by the user while ensuring a high level of cleanliness.

Another objective of the invention is to enhance accessibility and ease of use. The automatic activation of the device when a hand is inserted allows for hands-free operation, making it particularly useful for individuals with limited mobility or physical dexterity.

Yet another objective of the invention is to ensure effective cleaning of hard-to-reach areas. With its center brush specifically targeting the fingertips and the coordinated rotation of the upper and lower brushes, the device aims to provide comprehensive cleaning, addressing areas that are often missed during manual scrubbing.

It will also be appreciated that various combinations of the features disclosed hereafter for a hand scrubbing device are also possible as desired.

DETAILED DESCRIPTION OF THE INVENTION

Figure 1:
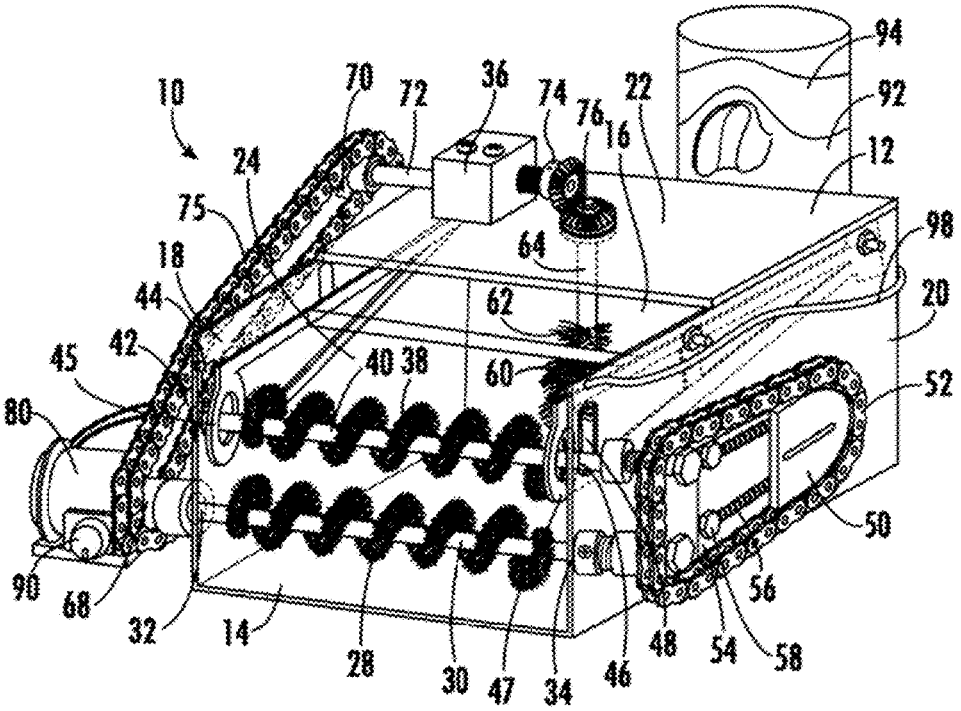
FIG. 1 is a perspective view of a hand scrubbing device.
Figure 2:
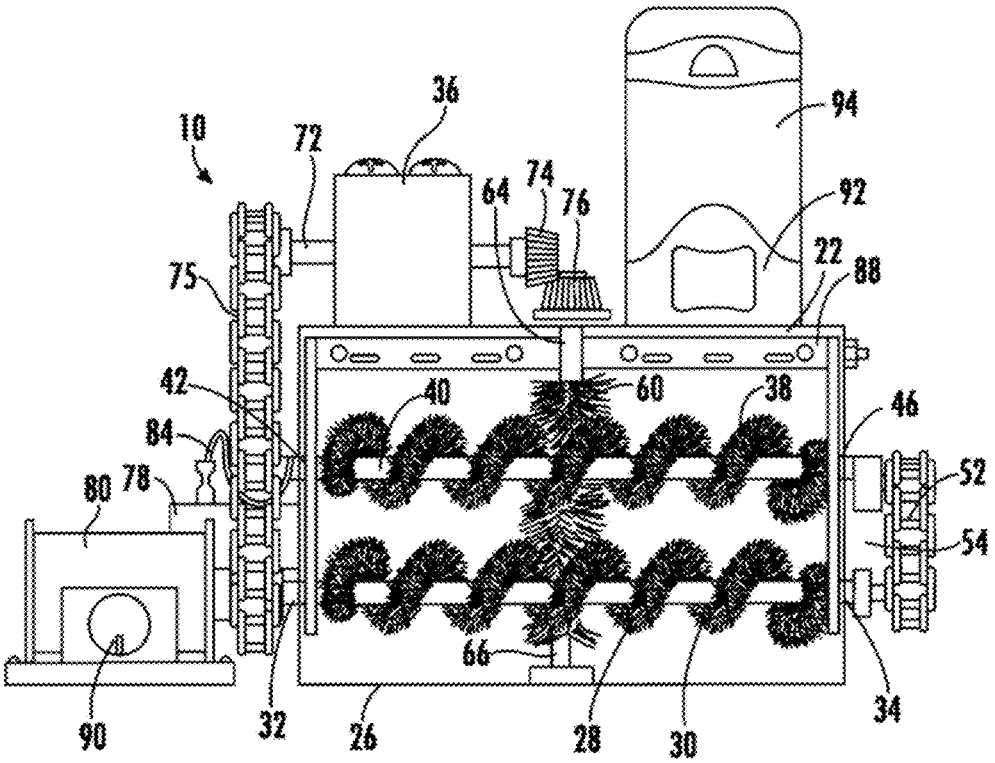
FIG. 2 is a front view thereof.
Figure 3:
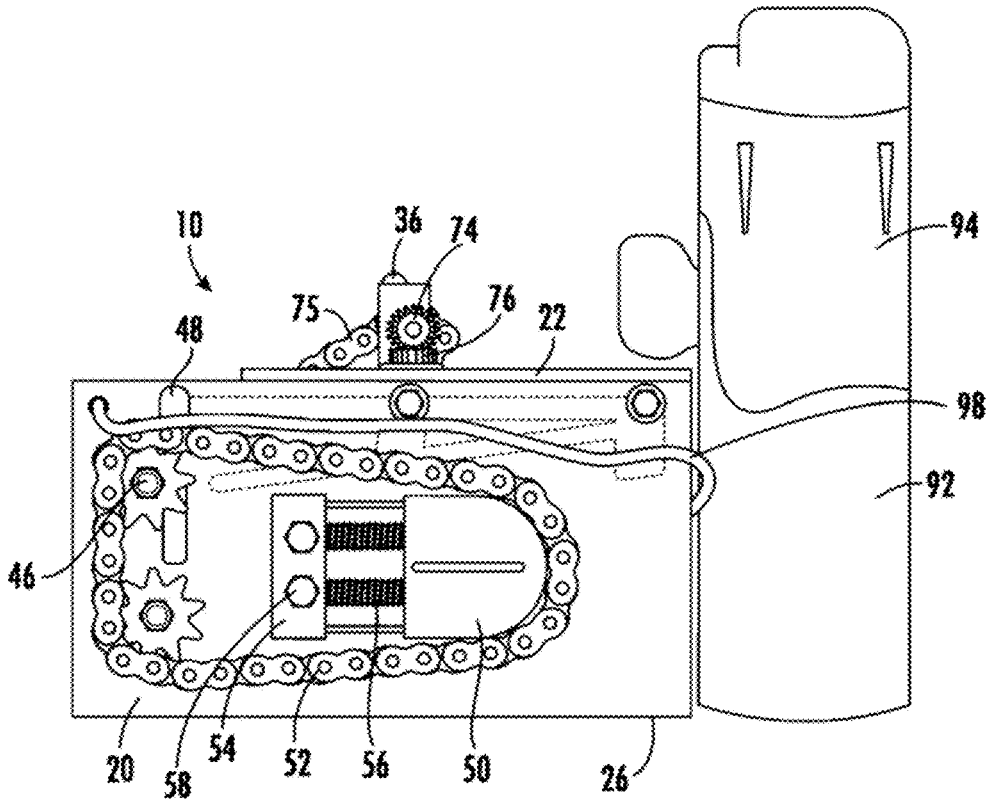
FIG. 3 is a right side view thereof.
Figure 4:
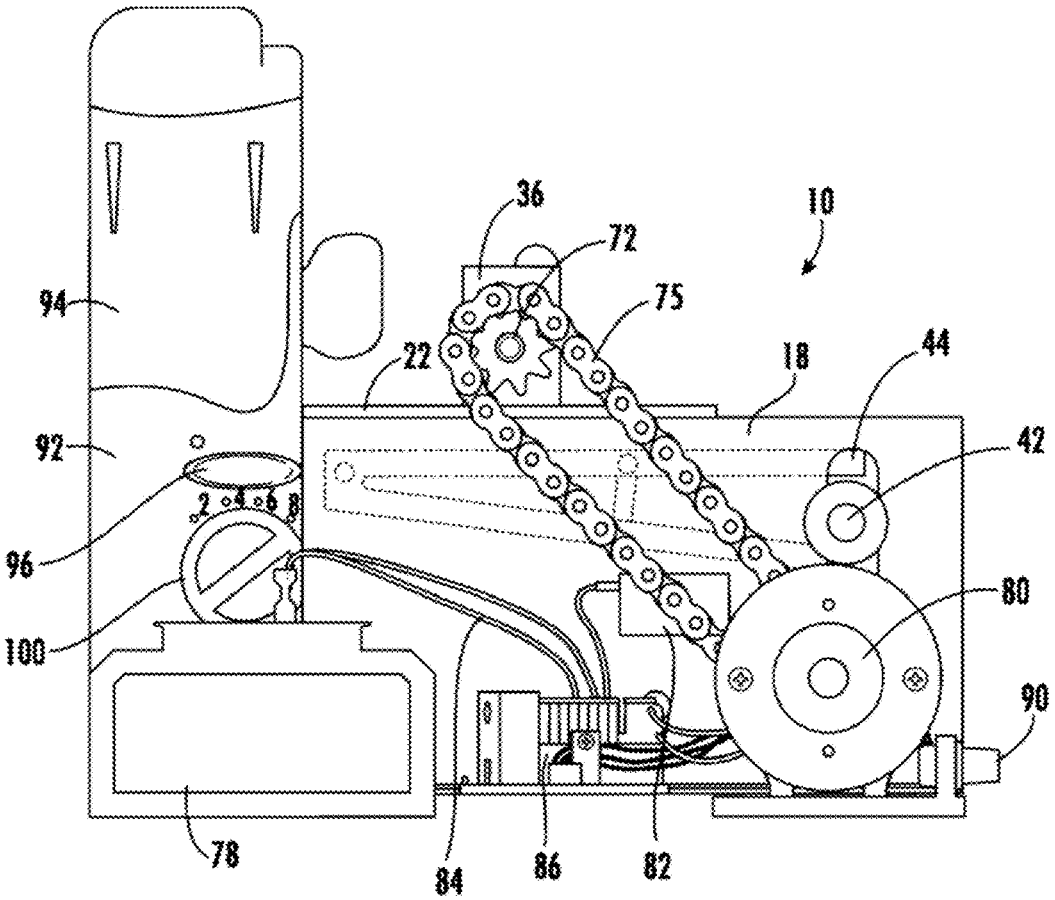
FIG. 4 is a left side view thereof.
Figure 5:
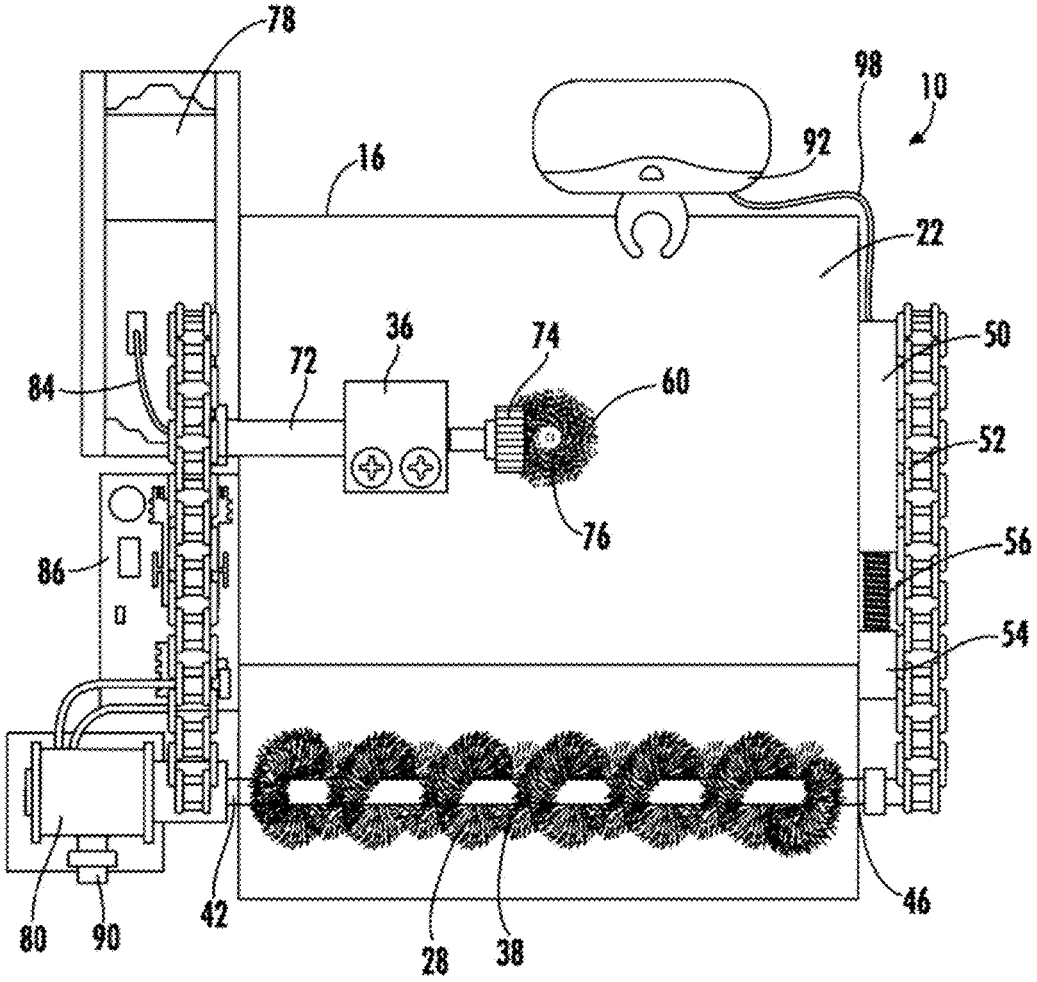
FIG. 5 is a top view thereof.
Figure 6:
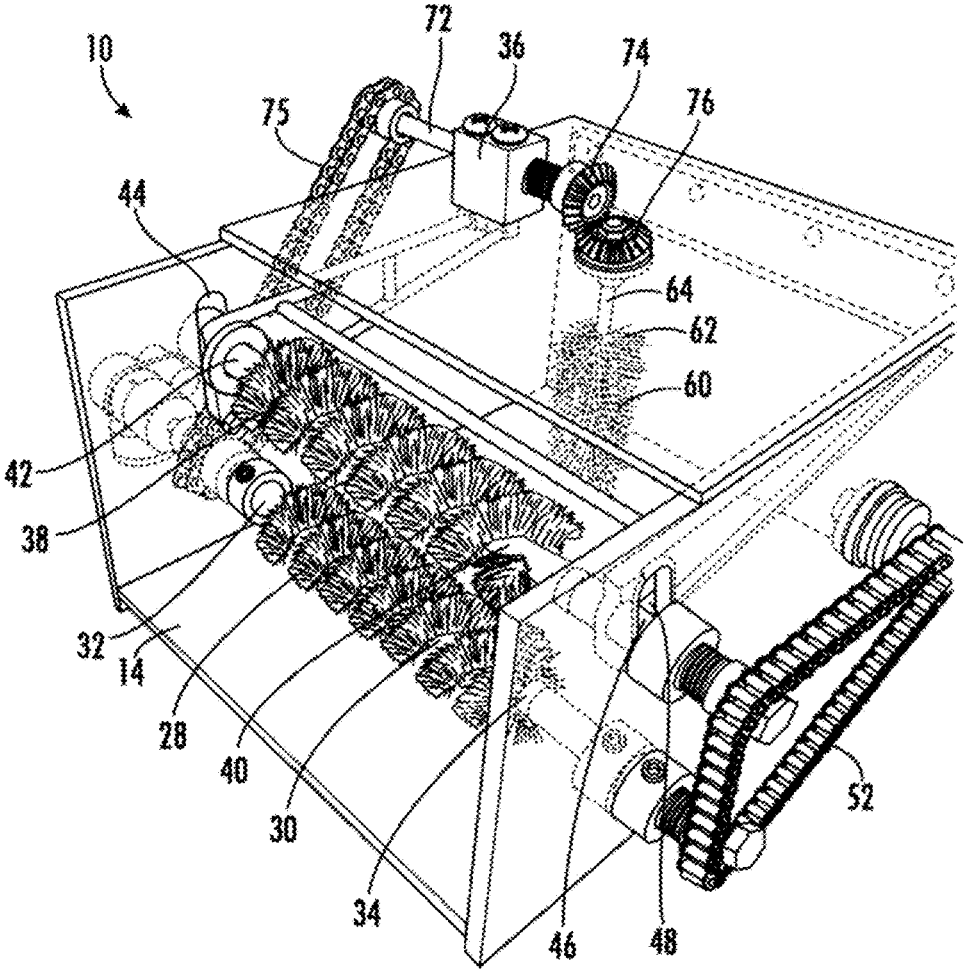
FIG. 6 is a perspective view thereof.
Figure 7:
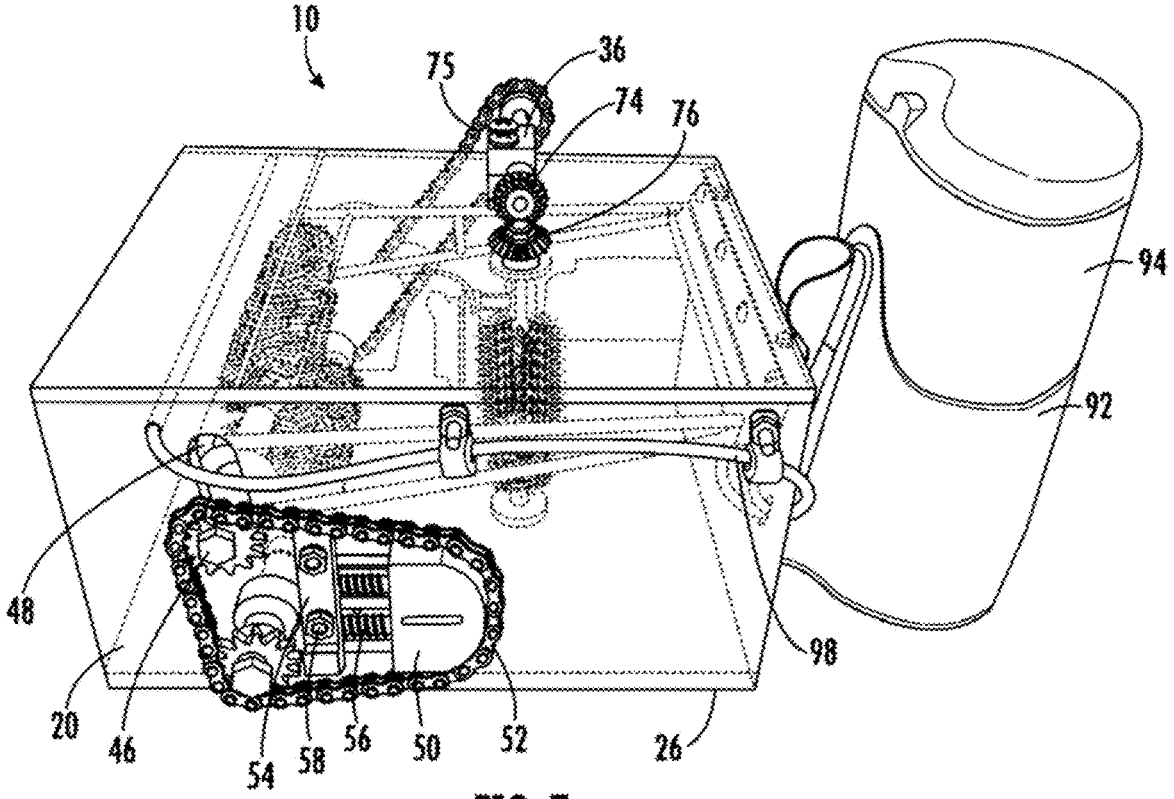
FIG. 7 is a right side perspective view thereof.
Figure 8:
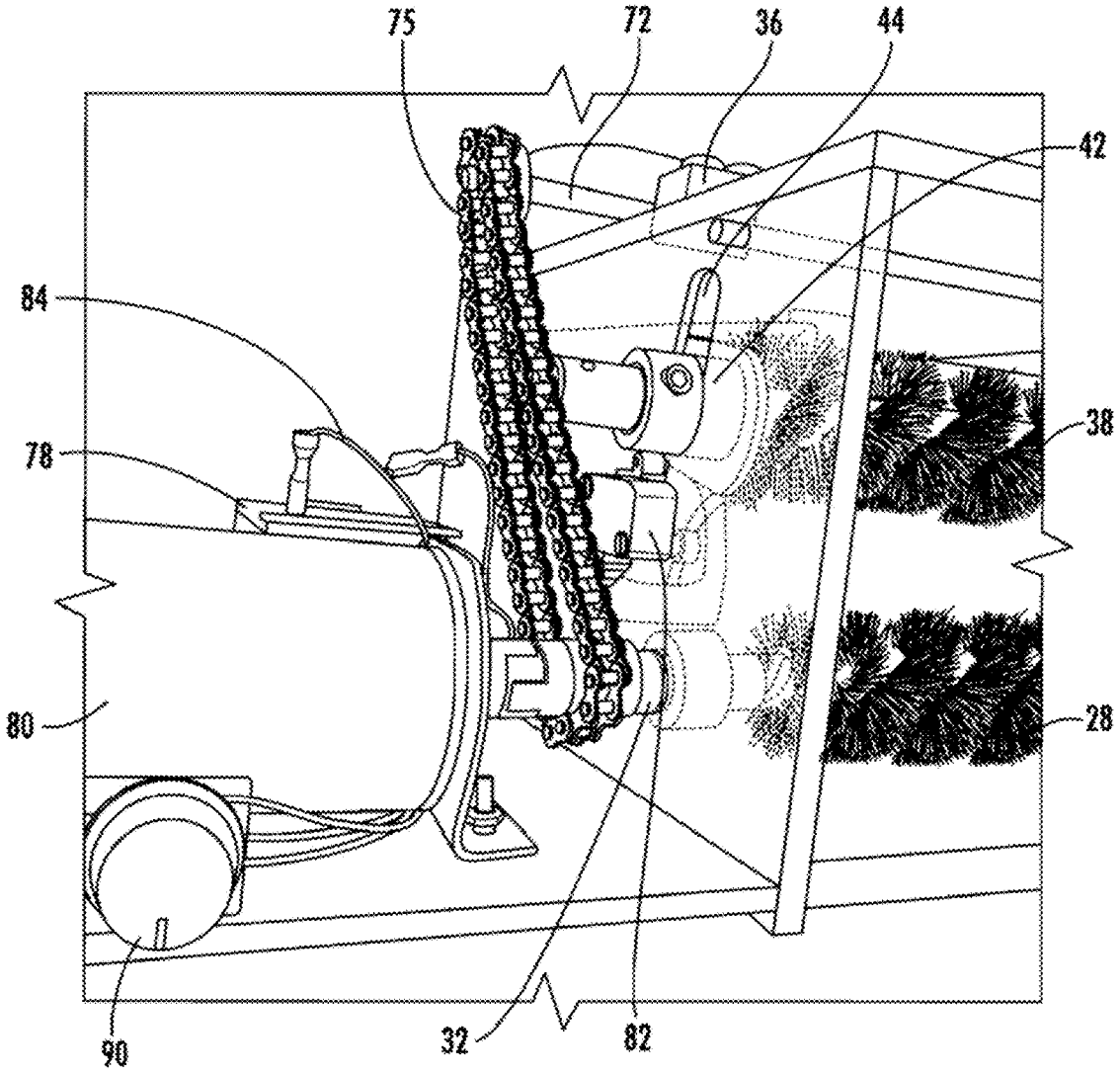
FIG. 8 is a detailed view of the left side of the hand scrubbing device.
Figure 9:
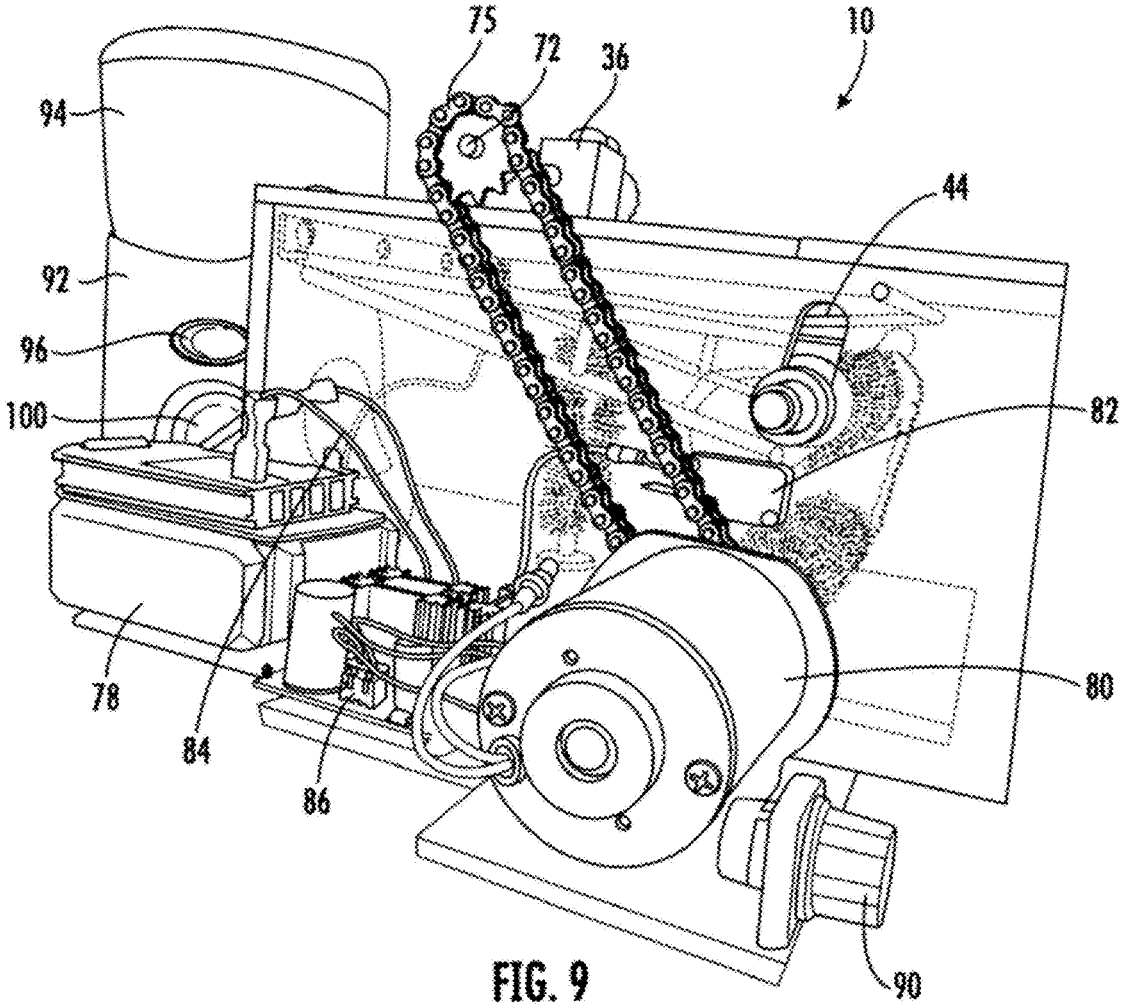
FIG. 9 is a left side perspective view thereof.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Now referring to the figures, a hand scrubbing device 10 is disclosed. The hand scrubbing device 10 includes a housing 12 that has a sloped bottom wall 14, a rear wall 16, spaced apart left 18 and right side walls 20, and a top panel 22, forming a chamber 24 between these walls. In a preferred embodiment, the top panel 22 is transparent plastic, so that the user can visually view the operation of the brushes within the chamber 24. The sloped bottom wall 14 directs fluid toward a drainage port 26 located adjacent to the rear wall 16, ensuring efficient removal of or water cleaning solution during operation. This drainage feature is particularly important in preventing fluid buildup, which can hinder the cleaning process and affect the hygiene of the device 10.

Within the chamber 24, the device 10 includes a lower brush 28 mounted on a horizontally disposed shaft 30. The first end 32 of the shaft 30 is coupled to the left side wall 18, and the second end 34 is coupled to the right side wall 20. The lower brush 28 rotates in a first direction and is responsible for cleaning the underside of the user's hand. When the user inserts their hand, the lower brush 28 scrubs the palm consistently and thoroughly across the hand's surface, even when handling more stubborn dirt or grease. A top motor 36 is coupled to the first end 32 of the lower brush 28, driving its rotation.

Mounted above the lower brush 28 is an upper brush 38, attached to a second horizontally disposed shaft 40. The second horizontally disposed shaft 40 has a first end 42 that is slidably secured to a first slot 44 in the left side wall 18 and a second end 46 slidably secured to a second slot 48 in the right side wall 20, allowing the upper brush 38 to move vertically. The upper brush 38 rotates in the opposite direction of the lower brush 28, ensuring counter-rotational cleaning action. The upper brush 38 is restricted from moving horizontally by a first retaining ring 45 restricting the first end 42 from moving and a second retaining ring 47 restricting the second end 46 from moving. The vertical movement of the upper brush 38 allows it to adjust to different hand sizes and shapes by applying even pressure across the hand. As the upper brush 38 moves, it cleans the top of the user's hand. The upper brush 38 also ensures that all parts of the hand are scrubbed effectively, even areas that might be missed in manual washing.

The lower brush 28 second end 34 is coupled to the upper brush 38 second end 46 using a self-adjusting chain tensioner 50 wherein the upper brush 38 can be moved along the slot 48 while a first coupling chain 52 maintains a constant tension. The self-adjusting chain tensioner 50 is coupled to a retaining block 54 by springs 56. The springs 56 allow for a constant tension when the upper brush 38 moves vertically within the slots 44, 48 for smooth operation. The retaining block 54 is mounted onto the right side wall 20 with a plurality of fasteners 58, such as screws or bolts.

Additionally, a center brush 60 is mounted on a vertically disposed shaft 62, with the upper end 64 of the shaft 62 connected to the top panel 22 and a lower end 66 secured to the bottom wall 14. The center brush 60 is specifically designed to focus on cleaning the user's fingertips, which are often difficult to reach in manual scrubbing. The rotation of the center brush 60 ensures that the fingertips receive concentrated cleaning, removing dirt and grime that can accumulate in and around the nails.

The first end 32 of the lower brush 28 includes a lower sprocket 68, which is coupled to a reciprocal sprocket 70 on an idler block shaft 72. The idler block shaft 72 is equipped with an end-mounted horizontal bevel gear 74 that rotates a vertical bevel gear 76 on the upper end 64 of the center brush shaft 62, ensuring that the rotation of the lower sprocket 68 powers the rotation of the center brush 60. A second coupling chain 75 is coupled to both the lower sprocket 68 and the reciprocal sprocket 70 which in turn drives power from the lower brush 28 to the idler block shaft 72.

The hand scrubbing device 10 is powered by a battery 78, which may be a classic 20V lithium battery, for example, which supplies energy to a motor 80 and other electrical components that may exist. The battery 78 is housed either within or outside of the device 10 and connected to the motor 80 and a micro switch 82 via a plurality of wires 84. These wires 84 run to a circuit board 86, which acts as the central control system for the device 10. The circuit board 86 manages the distribution of power from the battery 78 to the motor 80 and other components, ensuring that the device 10 operates efficiently. The circuit board 86 is also connected to the micro switch 82, allowing it to regulate the activation of the motor 80 and ultimately a spray nozzle 88. This configuration ensures that the motor 80 and nozzle 88 only engage when the user inserts their hand and lifts the upper brush 38, conserving power and optimizing the operation of the device 10.

The device operates through the motor 80 that drives the lower 28, upper 38, and center 60 brushes. When power is applied, the motor 80 rotates the brushes 28, 38, 60 to facilitate the cleaning process. Power to the motor may be adjusted via a power control knob 90 electronically connected to the motor 80. A spray nozzle 88 is placed within the chamber 24, preferably positioned above the upper brush 38, and is fluidly connected to a water source 92. The water source 92 includes a water receptacle 94 that is coupled to a water pump 96. This pump 96 is activated by a micro switch 82, allowing water or cleaning fluid to be dispersed during use.

The micro switch 82 is engaged by movement of the upper brush 38. When the user inserts their hand between the lower 28 and upper brushes 38, the upper brush 38 is lifted along its slots 44, 48, activating the micro switch 82. This action turns on the motor 80, causing the brushes 28, 38 to rotate, and simultaneously activates the spray nozzle 88 to release fluid. The spray nozzle 88 may be connected to a hose 98 that delivers fluid from the water source 92 to the spray nozzle 88. The circuit board 86 receives signals from the micro switch 82 and sends the necessary power from the battery 78 to engage both the motor 80 and the pump 96, ensuring that the brushes 28, 38 and spray nozzle 88 work in unison for a thorough cleaning. The power of the pump 96 may be adjusted via a knob 100 located on the water source 92. The combination of the rotating brushes 28, 38 and the water flow creates an effective and automated hand-cleaning process. This device 10 is especially beneficial for users who need to remove tough grime or contaminants, as the rotating brushes 28, 38 and water spray ensure a thorough and hygienic clean.

The entire design of the device 10, from the sloped bottom wall 14 to the coordinated movement of the lower 28, upper 38, and center 60 brushes, is optimized for continuous use. The drainage system ensures that the device remains free from excess fluid buildup, making it ideal for environments where frequent hand cleaning is required, and cleanliness is critical. The battery-powered system allows for portability, making the device 10 suitable for various work environments without requiring constant access to a power outlet. The device 10, however, is not limited to only battery power and may be plugged into a power outlet when the need is suited.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

One skilled in the art will readily appreciate that the present invention is well adapted to carry out the objectives and obtain the ends and advantages mentioned, as well as those inherent therein. The embodiments described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hand scrubbing device comprising:

a housing defined by a bottom wall, supporting a rear wall, spaced apart left and right side walls, and a top panel forming a chamber therebetween, said bottom wall having a slope for directing fluid to a drainage port adjacent said rear wall;

a lower brush mounted on a first horizontally disposed shaft having a first end coupled to said left side wall and a second end coupled to said right side wall, said lower brush rotatable in a first direction;

an upper brush mounted above said lower brush employing a second horizontally disposed shaft having a first end slidably secured to a first slot in said left side wall and a second end slidably secured to a second slot in said right side wall, said upper brush rotatable in an opposite direction to said lower brush;

a center brush mounted on a vertically disposed shaft having an upper end rotatably coupled to said top panel and a lower end rotatably coupled to said bottom wall;

a lower sprocket coupled to said first end of said first shaft coupled to a reciprocal sprocket attached to an idler block shaft having an end mounted horizontal bevel gear for rotating a vertical bevel gear on said upper end of said center brush shaft, wherein rotation of said lower sprocket rotates said center brush;

a motor coupled to said lower brush, said upper brush and said center brush, said motor rotating said brushes when power is applied to said motor;

a water source fluidly coupled to a spray nozzle placed within said chamber; and a micro switch engaging said upper brush, said micro switch activating said motor and said spray nozzle when said upper brush is moved along a length of said slots;

wherein insertion of an individual's hand between said lower and upper brush requires lifting of said upper brush which activates the micro switch causing rotation of said brushes and dispersing of fluid from said water source, whereby said upper and lower brushes are arranged to clean the individual's hand and said center brush arranged for cleaning the individual's fingertips.

2. The hand scrubbing device according to claim 1 wherein said top panel is transparent plastic.

3. The hand scrubbing device according to claim 1 wherein said motor is coupled to said end of said first shaft.

4. The hand scrubbing device according to claim 1 wherein said lower brush second end is coupled to said upper brush second end using a self-adjusting chain tensioner wherein said upper brush can be moved along said first and second slots while a first coupling chain maintains a constant tension.

5. The hand scrubbing device according to claim 1 wherein said water source is a water receptacle fluidly coupled to a water pump, said water pump activated by said micro switch.

6. The hand scrubbing device according to claim 1 wherein said spray nozzle is positioned above said upper brush.

* * * * *